US005326164A

United States Patent [19]

Logan

[11] Patent Number: 5,326,164

[45] Date of Patent: Jul. 5, 1994

[54] FLUID MIXING DEVICE

[76] Inventor: James R. Logan, 4732-18th Ave. Ct., Moline, Ill. 61265

[21] Appl. No.: 142,872

[22] Filed: Oct. 28, 1993

[51] Int. Cl.[5] ..... B01F 11/02

[52] U.S. Cl. ..... 366/127; 366/339; 366/600

[58] Field of Search ..... 366/108, 127, 600, 336, 366/337, 338, 339, 273

[56] References Cited

U.S. PATENT DOCUMENTS 3,410,765 11/1968 Bodine ..... 366/600
4,307,964 12/1981 Dudgeon ..... 366/127
4,352,570 10/1982 Firth ..... 366/127
4,602,184 7/1986 Meitzler ..... 366/127

*Primary Examiner*—Robert W. Jenkins
*Attorney, Agent, or Firm*—James C. Nemmers

[57] ABSTRACT

A device for mixing fluid materials using chaotic flow combined with sonic energy. The device includes sine wave baffles to produce mixing by folding, stretching and breaking the material as it continuously flows and simultaneously chopping the mixed material with vorticular motion using pressure fronts produced by sonic energy generators.

10 Claims, 3 Drawing Sheets

FLUID MIXING DEVICE

BACKGROUND OF THE INVENTION

This invention relates to a unique combination of two known ways of mixing fluids. The system combines dynamic systems, such as impellers or static mixers, with linear actuators such as sonic or ultrasonic driven devices.

The mixing of a very viscous liquid with either a solid or a liquid of low viscosity has always been a difficult task. In any fluid flow, "chaos" occurs whenever the fluid elements are stretched or folded, and this chaos produces mixing. However, chaotic mixing alone is not sufficient in some instances to produce complete and efficient mixing, since the chaos may occur in only certain regions of the fluid flow. Therefore, islands of unmixed material will persist in even the most chaotic of flows.

Mixing of fluids can also be improved by the use of time-periodic changes in geometry. For example, by causing a fluid to flow down a channel in which a sine wave baffle has been added, chaotic advection is generated. An example of a device that attempts to combined dynamic systems of mixing with linear actuators is shown in Federal Republic of Germany Patent DL 204,403 in which the fluid is first mixed in a static mixer utilizing helices after which the fluid is mixed downstream by a nozzle producing variable frequency vibration in the 10–30 kHz range. However, devices of this type first mix the material and subsequently chop it. Especially with certain types of materials, this does not produce efficient mixing. There is therefore a need for an improved device that can efficiently and effectively combine chaotic mixing with the effects of sonic energy to produce a much improved and superior mixing and reactance of the materials.

SUMMARY OF THE INVENTION

The invention provides a device in which the fluid material is folded, stretched and broken down in a continuous motion using sinusoidly static mixing while simultaneously chopping the material with a vorticular motion from pressure fronts produced by sonic energy. In this manner, the two mixing actions are simultaneously produced resulting in a mixing action that is superior to that produced by prior art devices.

DESCRIPTION OF THE PREFERRED EMBODIMENT OF THE INVENTION

Figure 1:
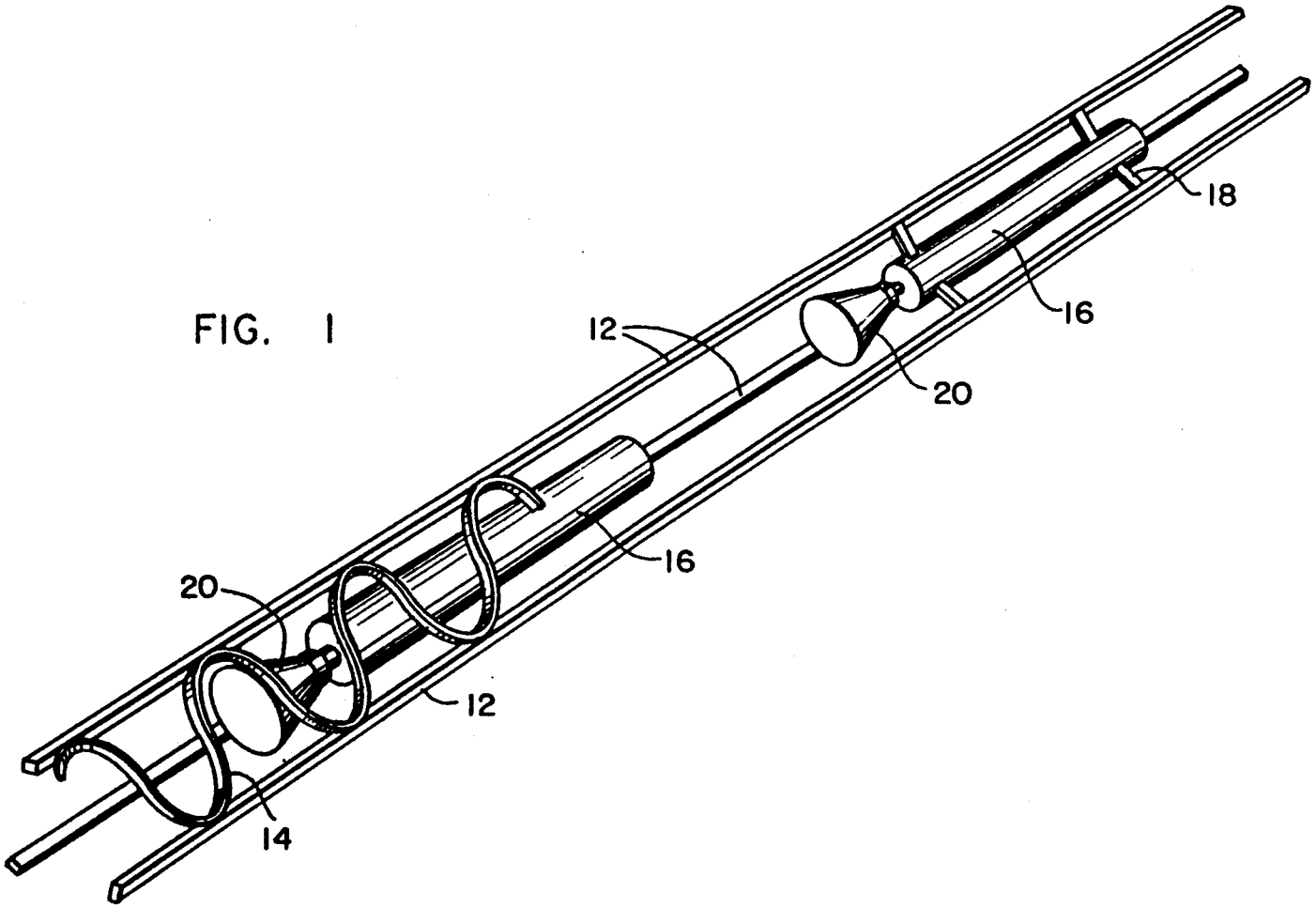
FIG. 1 is a perspective view of a device constructed according to the principles of the invention and showing the device designed for insertion in a tube or pipe of circular cross section.

Referring first to FIG. 1 of the drawings, the mixing device of the invention is illustrated for use in connection with a pipe or tube having a circular cross section.

Figure 2:
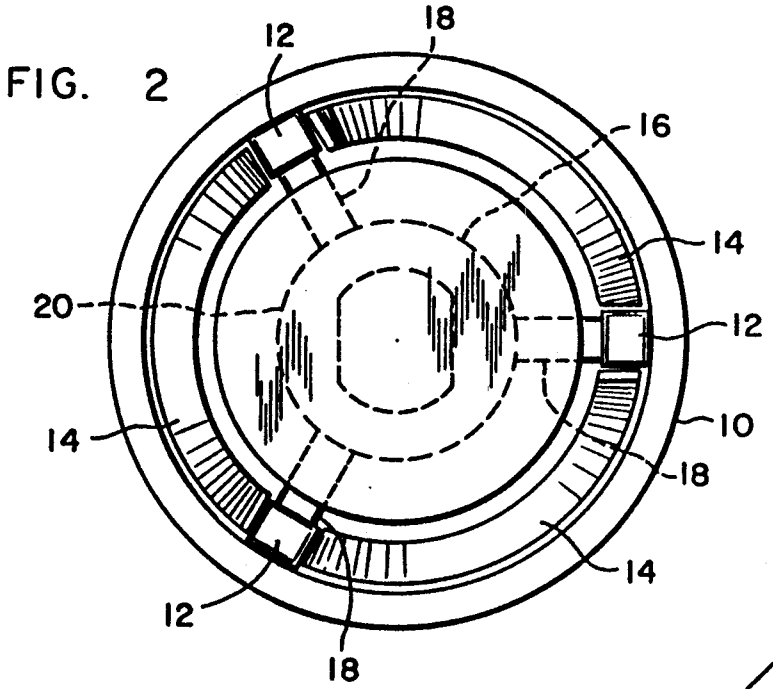
FIG. 2 is an end view of the device of FIG. 1 and showing the device inside of a pipe or tube of circular cross section.
Figure 3:
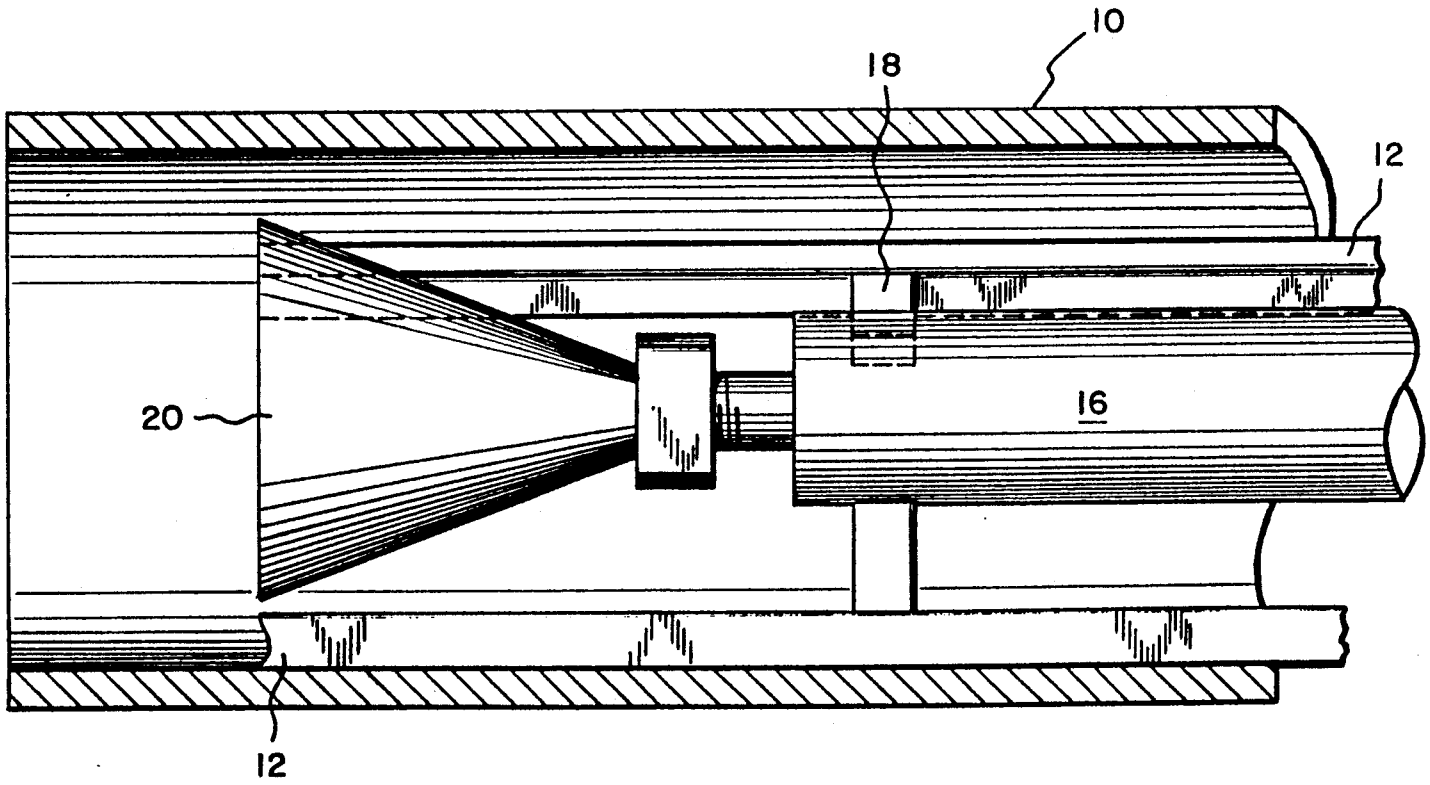
FIG. 3 is an enlarged side elevational view of the device of FIGS. 1 and 2 with the pipe in longitudinal section to illustrate some of the details of the sonic generator.

The device of the invention is inserted in the pipe or tube 10 (see FIG. 2) through which the material to be mixed is flowing. The device of the invention has a three axially extending channels 12 that are spaced apart 120 degrees and are thus equally spaced apart. These channels 12 provide support for the components of the device as well as facilitating insertion of the device in the pipe or tube 10.

Supported by the channels 12 by being affixed to them is a baffle or barrier 14 that follows a sinuous path along the channels 12. The barrier 14 preferably follows a sine curve, and when the device of the invention is inserted inside of the pipe 10 through which the fluid material is flowing, the barrier 14 will produce mixing of the fluid material by producing chaotic flow due to the stretching and folding of the fluid material as it flows through the pipe 10. This dynamical chaos will produce the desired result of mixing the material to a certain degree. However, especially if the fluid material consists of two phases, and one is very viscous and the other is a solid or liquid of low viscosity, this chaotic mixing does not produce the most superior and desired mixing in an efficient manner. Islands of unmixed material will persist in even the most chaotic of flows.

Therefore, the device of the invention also includes sonic generator units 16 which are spaced apart axially along the length of the device. The sonic generator units are supported by support members 18 which connect the sonic generators 16 to the channels 12 and position the sonic generators 16 along the central axis of the device. The sonic generators 16 can be of any suitable type capable of producing sonic energy within the range of 1–10 kHz. In addition, each of the sonic generators 16 has combined with it a reverse acoustical cone 20 driven by the sonic generator 16 to which it is attached resulting in axially movement that produces pressure fronts forwardly and outwardly from the cones 20. Thus, the sonic generators 16 and cones 20 produce a "chopping" effect on the fluid material flowing through the pipe 10. This chopping effect results from the vorticular motion produced by the sonic pressure fronts which aid in the disruption of the islands of unmixed material by reducing surface pressure and interface disruption. As noted earlier, these islands of unmixed material will persist in spite of the chaotic flow, and those skilled in the art are aware of the emulsifying ability of sound, which can reduce large globs of material to micron and even smaller droplets.

Thus, the repeated folding and stretching produced by the barrier 14 with the fluid material in continuous motion is combined with the chopping action of the sonic generators 16 and cones 20 resulting in a superior mixing action over known prior art devices.

Figure 4:
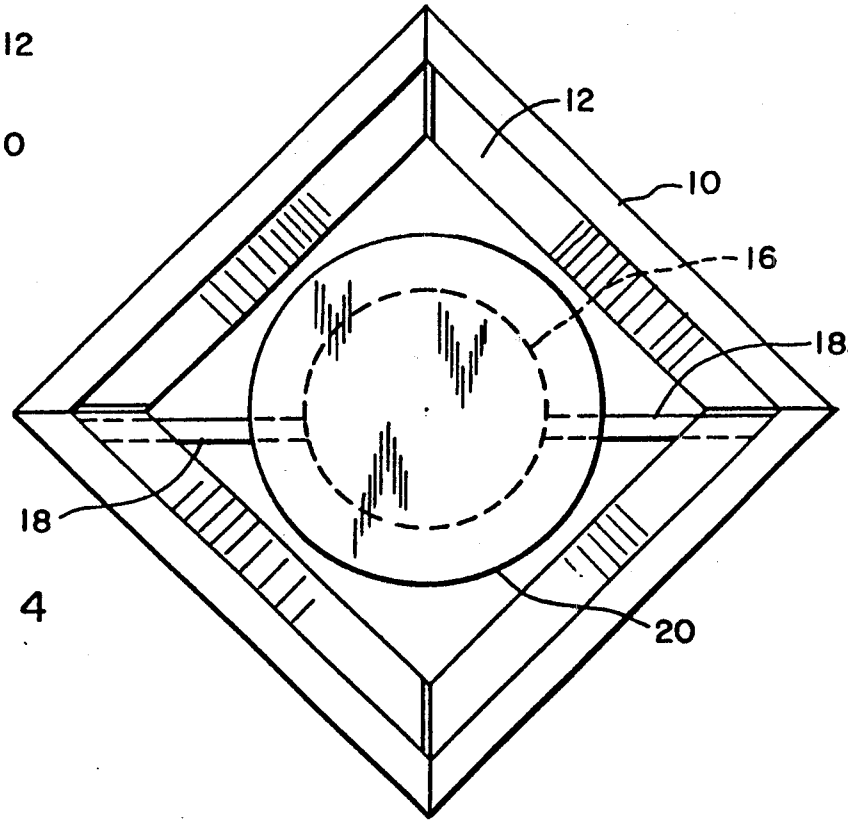
FIG. 4 is an end view similar to FIG. 2 but showing the device designed for insertion in a square tube.

FIG. 4 shows an end view of a second embodiment of the invention in which the mixing device is contained within a tube having a square cross sectional shape. With the second embodiment, the basic action of the chaotic mixing of the barrier 14 combined with the vorticular motion produced by the sonic generators 16 and cones 20 is basically the same as that of the first embodiment. However, in some applications, the square tube version may be preferred.

In either of the embodiments, the effective mixing, especially of two materials consisting of a fluid and a solid, can be achieved in a reduced amount of time. The effective mixing in the reduced amount of time is made possible by the vorticular motion being applied simultaneously during the continuous chaotic flow produced by the sinusoidal barrier 14. The number of sonic generators 16 and the particular configuration of the sinusoidal barrier 14 will depend upon the particular materials that are to be mixed. In some instances, a single sonic generator 16 may be all that is necessary, while in others two or more such generators may be required. It is important, however, that a continuous chaotic mixing produced by the barrier 14 be continuous throughout the length of the pipe or tube 10 in which the sonic generators 16 are located so that chaotic mixing and the vorticular motion produced by the sonic generators 16 occurs simultaneously.

Having thus described the invention in connection with preferred embodiments thereof, it will be evident to those skilled in the art that various revisions and modifications can be made to the preferred embodiments described herein without departing from the spirit and scope of the invention. It is my intention, however, that all such revisions and modifications that are obvious to those skilled in the art will be included within the scope of the following claims:

What is claimed is as follows:

1. An apparatus for thoroughly mixing a flowable material, said apparatus comprising a tubular enclosure having an inside surface and through which the flowable material to be mixed can be passed, a fixed barrier extending along the inside surface of the tubular enclosure so as to produce chaotic flow of the material passing through the enclosure, and a sonic generator positioned inside of the barrier to produce a chopping action on material passing through the enclosure which chopping action occurs simultaneously with the chaotic flow of the material produced by the fixed barrier.

2. The apparatus of claim 1 in which the fixed barrier extends along the inside surface of the tubular enclosure in a sinuous path.

3. The apparatus of claim 2 in which there is combined with and driven by the sonic generator a reverse acoustical cone so as to produce pressure fronts.

4. The apparatus of claim 3 in which the sonic energy produced by the sonic generator is within the range of 1–10 kHz.

5. The apparatus of claim 1 in which the fixed barrier is a relatively thin member that extending along the inside surface of the tubular enclosure so as to leave the center area of the enclosure open, and the sonic generator is positioned in the center area of the enclosure along its central axis.

6. The apparatus of claim 5 in which there are axially extending channels to which the barrier is attached, and the sonic generator is also attached to said channels, said channels, barrier and sonic generator forming a mixing unit insertable in and removable from the tubular enclosure.

7. A method for thoroughly mixing a flowable material, said method comprising the steps of: causing the material to flow through a tubular enclosure; directing the material flow along a predetermined path inside the tubular enclosure so as to produce chaotic flow of the material; and generating sonic energy and directing said energy into the material simultaneously with the chaotic flow to produce a chopping action on the material which chopping action occurs simultaneously with the chaotic flow of the material thereby to thoroughly mix the material.

8. The method of claim 7 in which the material is caused to flow along a sinuous path inside the tubular enclosure to produce the chaotic flow.

9. The method of claim 8 in which the sonic energy generated produces pressure fronts that produce the chopping action on the material.

10. The method of claim 9 in which the sonic energy generated is within the range of 1–10 kHz.

* * * * *